US008920054B2

(12) United States Patent
Yokoyama

(10) Patent No.: US 8,920,054 B2
(45) Date of Patent: Dec. 30, 2014

(54) ROLL TAPE AND PRINTER

(71) Applicant: Casio Computer Co., Ltd., Shibuya-ku, Tokyo (JP)

(72) Inventor: Yoshimasa Yokoyama, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/770,843

(22) Filed: Feb. 19, 2013

(65) Prior Publication Data

US 2013/0216292 A1 Aug. 22, 2013

(30) Foreign Application Priority Data

Feb. 20, 2012 (JP) ..... 2012-033833

(51) Int. Cl.

| | |
|---|---|
| ***B41J 15/00*** | (2006.01) |
| ***B41J 15/02*** | (2006.01) |
| ***B41J 3/407*** | (2006.01) |
| ***B41J 11/00*** | (2006.01) |
| ***B41J 15/04*** | (2006.01) |
| ***B65H 35/00*** | (2006.01) |
| ***B65H 75/10*** | (2006.01) |
| ***B65H 75/18*** | (2006.01) |

(52) U.S. Cl.

CPC ..... *B41J 15/02* (2013.01); *B41J 3/4075* (2013.01); *B41J 11/0025* (2013.01); *B41J 15/04* (2013.01); *B41J 15/042* (2013.01); *B65H 35/0006* (2013.01); *B65H 75/10* (2013.01); *B65H 75/185* (2013.01); *B65H 2701/37* (2013.01)

USPC ..... 400/613; 400/611

(58) Field of Classification Search

USPC ..... 400/613

See application file for complete search history.

(56) References Cited

U.S. PATENT DOCUMENTS

| | | | | |
|---|---|---|---|---|
| 1,962,959 | A * | 6/1934 | Kinloch | 242/160.4 |
| 3,516,342 | A * | 6/1970 | Luescher | 242/598.6 |
| 5,356,086 | A | 10/1994 | Takagi | |

(Continued)

FOREIGN PATENT DOCUMENTS

| | | |
|---|---|---|
| EP | 0 872 353 A2 | 10/1998 |
| JP | H02163247 (A) | 6/1990 |

(Continued)

OTHER PUBLICATIONS

Japanese Office Action dated Dec. 19, 2013 (and English translation thereof) in counterpart Japanese Application No. 2012-033833.

(Continued)

*Primary Examiner* — Anthony Nguyen

(74) *Attorney, Agent, or Firm* — Holtz, Holtz, Goodman & Chick PC

(57) ABSTRACT

There is provided a roll tape including a core main body portion having a double cylinder construction made up of an outer core portion and an inner core portion, a pair of shaft portions each having an insertion portion which can be fittingly inserted in the inner core portion, an outer shaft which can be fittingly inserted in the outer core portion and a bearing shaft that is thinner than and concentric with the outer shaft and which extends longer in one direction than the outer shaft and a printing tape which is wound around a tape core which has the pair of shaft portions disposed individually on both sides of the core main body portion.

12 Claims, 6 Drawing Sheets

(56) References Cited

U.S. PATENT DOCUMENTS

| | | | | |
|---|---|---|---|---|
| 5,943,085 | A | 8/1999 | Higashi et al. | |
| 6,109,804 | A | 8/2000 | Higashi et al. | |
| 6,196,495 | B1 | 3/2001 | Hwang et al. | |
| 6,639,655 | B2 * | 10/2003 | Ishizuka | 355/75 |
| 6,857,586 | B2 * | 2/2005 | Kadota et al. | 242/160.3 |
| 6,948,673 | B1 * | 9/2005 | Sato | 242/160.4 |
| 7,387,458 | B2 * | 6/2008 | Monteith et al. | 400/609 |
| 7,556,216 | B2 * | 7/2009 | Chandaria | 242/588.6 |
| 2002/0170996 | A1 * | 11/2002 | Fukugawa et al. | 242/160.4 |
| 2003/0155462 | A1 | 8/2003 | Takeda et al. | |
| 2006/0147243 | A1 * | 7/2006 | Blanchard et al. | 400/613 |
| 2008/0226376 | A1 * | 9/2008 | Monteith et al. | 400/613 |

FOREIGN PATENT DOCUMENTS

| | | | |
|---|---|---|---|
| JP | H0717671 (A) | | 1/1995 |
| JP | 11-042821 | A | 2/1999 |
| JP | 2003-155462 | A | 5/2003 |

OTHER PUBLICATIONS

Extended European Search Report (EESR) dated Jun. 18, 2013 (in English) issued in counterpart European Application No. 13155944.5.

* cited by examiner

ROLL TAPE AND PRINTER

CROSS-REFERENCE TO RELATED APPLICATION

This application is based upon and claims the benefit of priority under 35 USC 119 of the prior Japanese Patent Application No. 2012-33833 filed on Feb. 20, 2012, the entire contents of which are incorporated herein by reference.

BACKGROUND OF THE INVENTION

1. Field of the Invention

The present invention relates to a roll tape for use for a label tape and a printer for printing characters or symbols on this roll tape.

2. Description of the Related Art

Nowadays, there are printers for preparing any label by printing a character string on a tape member based on character data inputted from a keyboard or received from other equipment.

In these printers, there are various types of printers including a printer that can accommodate a printing tape and which includes a printing device, a display and an input keyboard and a printer that accommodates a printing tape and includes a printing head such as a thermal head without having a display and an input keyboard and which prints characters or symbols on the printing tape while feeding it out by a feed-out roller.

In addition, as to printing tapes to be used, there is a cassette-type printing tape that houses an ink ribbon and a label tape and which is configured to be loaded in a printer. Additionally, as disclosed in Japanese Unexamined Patent Application No. 11-42821, there is a printing tape which is made of a roll of paper such as a tape adapted to take print, and only the roll of paper is loaded in a tape accommodating portion of a printer.

Then, as to printers, there are many printers configured to receive for use tapes of different widths.

As printing tapes for use in such printers, tapes of different widths are used, and among them, tapes which are 6 mm wide, 12 mm wide, 18 mm wide and 36 mm wide are used much. Although tapes of such different widths are used, in the cassette-type printing tapes, a common cassette case configured to accommodate tapes of different widths is provided for use of these tapes of different widths in the same printer. In the roll tape-type printing tapes, a common roll shaft configured to support tapes of different widths is provided.

In the roll tape-type printing tapes, only a tape core is disposed after a printing tape has been consumed, which contributes to the conservation of natural resources. However, when printing tapes having different tape widths are used in a predetermined type of printer, a tape core has had to be commonized for these printing tapes so that not only a printing tape having a narrow tape width but also a printing tape having a wide tape width can be loaded in a tape accommodating portion of the printer.

Because of this, the printing tape having a narrow tape width is wound around the tape core having a wide width, leading to the waste of natural resources. In addition, it has been found from time to time that it is difficult to wind the narrow printing tape around the wide tape core with the center of the former aligned with the center of the latter.

BRIEF SUMMARY OF THE INVENTION

The present invention has been made with a view to solving the problems and an object thereof is to provide a printing roll tape having a tape core that can facilitate the loading of printing tapes of different tape widths in a printer and which can avoid the waste of natural resources.

According to an aspect of the invention, there is provided a roll tape including a core main body portion which includes an inner core portion and an outer core portion that extends further axially outwards than the inner core portion and which has a larger diameter than a diameter of the inner core portion, a pair of shaft portions each including an outer shaft of which at least part of an outer circumference is fittingly inserted into the outer core portion, an insertion portion that is concentric with the outer shaft and which projects further in one direction than the outer shaft so that at least part of an outer circumference thereof is fittingly inserted into the inner core portion and a bearing shaft that is concentric with the outer shaft and which projects further in the other direction than the outer shaft, and a printing tape which is wound around an outer circumference of the outer core portion of a tape core in which the pair of shaft portions are fittingly inserted into the core main body portion from both axial sides thereof for integral connection.

In addition, according to another aspect of the invention, there is provided a printer including a core main body portion which includes an inner core portion and an outer core portion that extends further axially outwards than the inner core portion and which has a larger diameter than a diameter of the inner core portion, a pair of shaft portions each including an outer shaft of which at least part of an outer circumference is fittingly inserted into the outer core portion, an insertion portion that is concentric with the outer shaft and which projects further in one direction than the outer shaft so that at least part of an outer circumference thereof is fittingly inserted into the inner core portion and a bearing shaft that is concentric with the outer shaft and which projects further in the other direction than the outer shaft, a roll tape made up of a printing tape which is wound around an outer circumference of the outer core portion of a tape core in which the pair of shaft portions are fittingly inserted into the core main body portion from both axial sides thereof for integral connection, a pair of guide grooves which support rotatably the shaft portions, and a printing portion that carries the printing tape while holding an unwound free end of the printing tape by a printing head and a platen which is disposed so as to face the printing head and which prints characters or symbols on the printing tape.

According to the aspects of the invention, the printing tape is wound around the tape core having on each side thereof the shaft portion including the insertion portion which can fittingly be inserted into the inner core portion and the outer shaft which can fittingly be inserted into the outer core portion, and therefore, the tape core or any printing tape that is wound around the tape core can be accommodated in a roll tape accommodating portion having a constant width at all times by the widths of the inner core portion and the shaft portions. In addition, by matching the width of the outer core portion to the width of a printing tape that is to be wound therearound, the printing tape can easily be wound around the outer core portion, and further, by using the outer core portion whose width matches the width of the printing tape to be wound around, the components can be commonized. Additionally, the printer can print easily characters or symbols on roll tapes having different widths which are wound around the tape core using the commonized components.

DETAILED DESCRIPTION OF THE INVENTION

Figure 1:
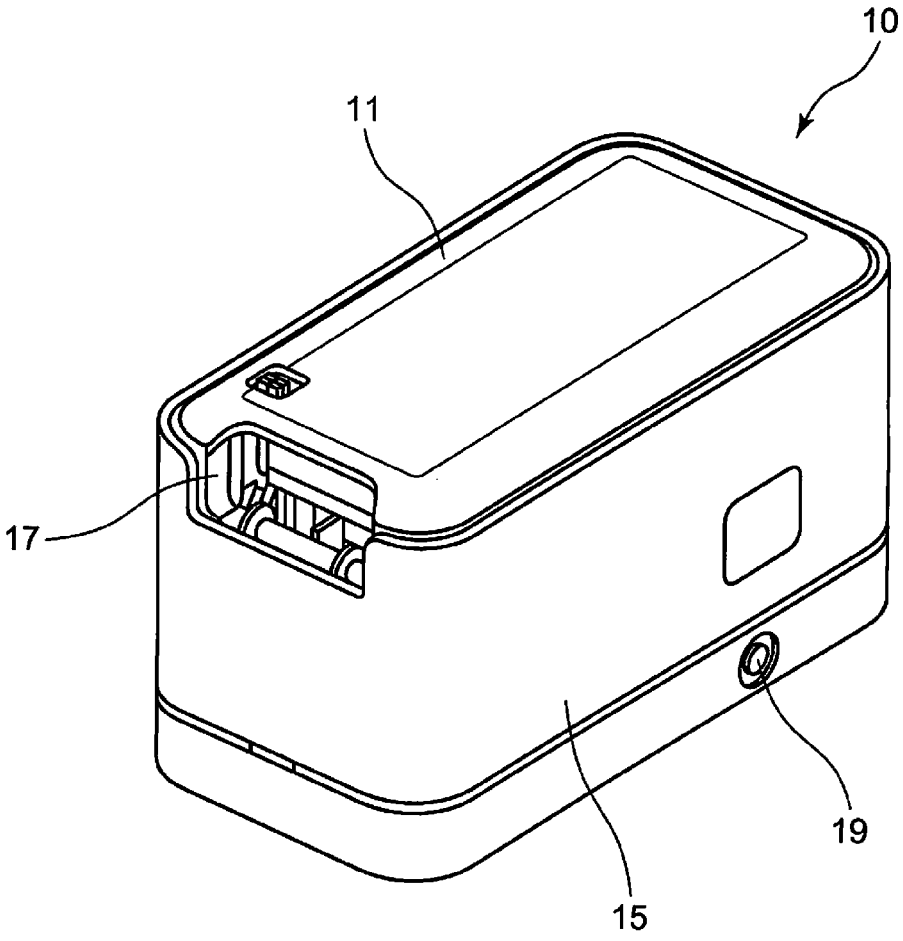
FIG. 1 is a perspective view depicting an external appearance of one example of a printer in which a roll tape according to the invention is used.

A roll tape according to the invention is such as to be used in a printer 10 shown in FIG. 1, for example.

As shown in FIG. 1, the printer 10 has an opening portion 17 at a front end of a cover portion 11 which forms an upper surface of the printer 10, and a tape on which characters or symbols have been printed is discharged from this opening portion 17. The printer 10 includes a printing mechanism in an interior thereof which is defined by front, rear, left and right side walls. Additionally, the printer 10 has a plug terminal 19 in a main body portion 15, and this plug terminal 19 receives printing data from a personal computer or a label preparing character inputting apparatus.

Figure 2:
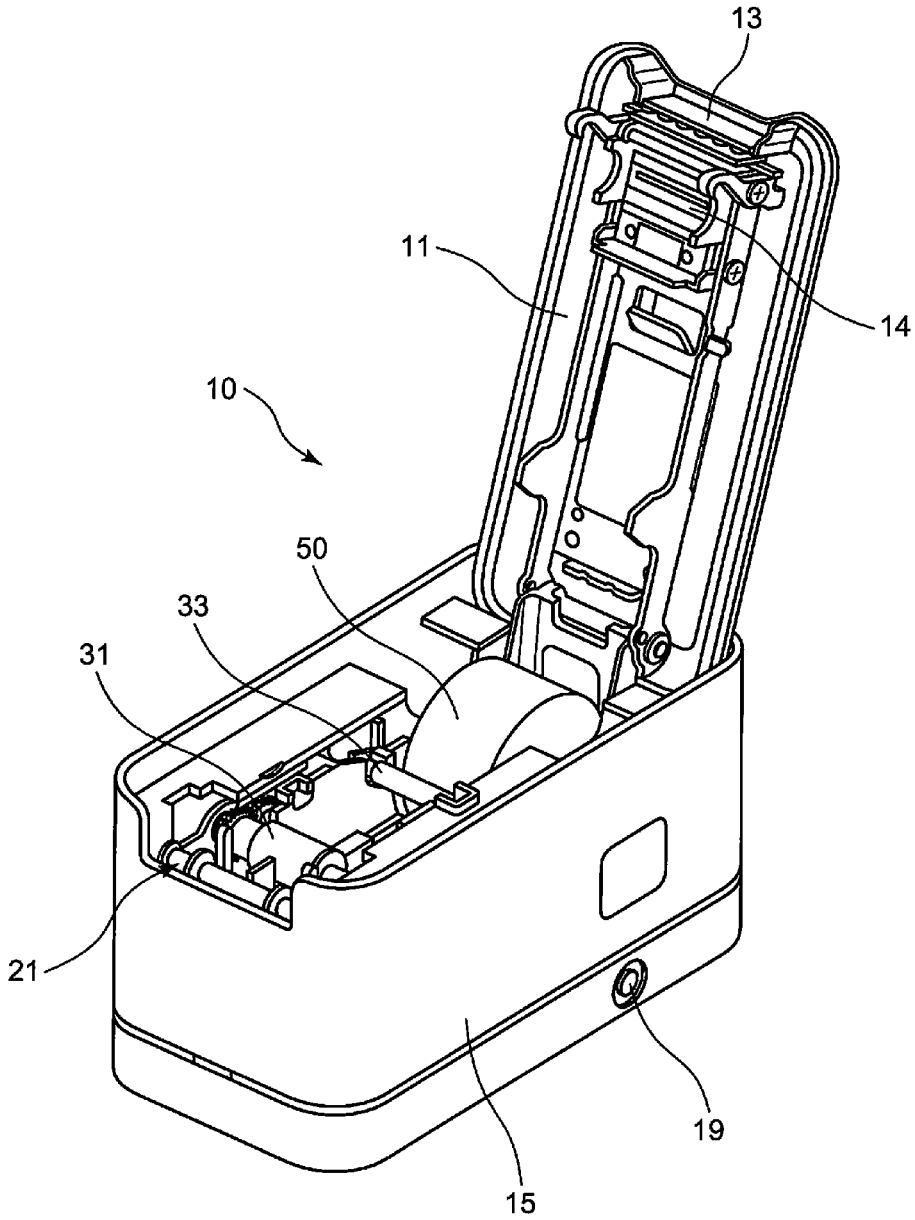
FIG. 2 is a perspective view depicting a tape accommodating state of the example of the printer in which the roll tape according to the invention is used.

As shown in FIG. 2, the printer 10 has a printing head 14 such as a thermal head and a cutter 13 near a distal end of an inner side of the cover portion 11, so that the printing tape on which characters or symbols are printed and then is discharged from the opening portion 17 can be cut by using the cutter 13 in the position of the opening portion 17.

Additionally, the printer 10 has a platen roller 31 in the main body portion 15 in a position which faces oppositely the position of the printing head 14 which is provided on the inner side of the cover portion 11, whereby characters, symbols or patterns are printed on a heat sensitive paper tape by the printing head 14 while feeding out the heat sensitive paper tape which is held by the printing head 14 and the platen roller 31 by using the platen roller 31.

In addition, a roll tape 50 is accommodated in the main body portion 15 of the printer 10 with both ends of a tape core supported in roll guide grooves in a printing unit 21 which is accommodated in the main body portion 15.

Figure 3:
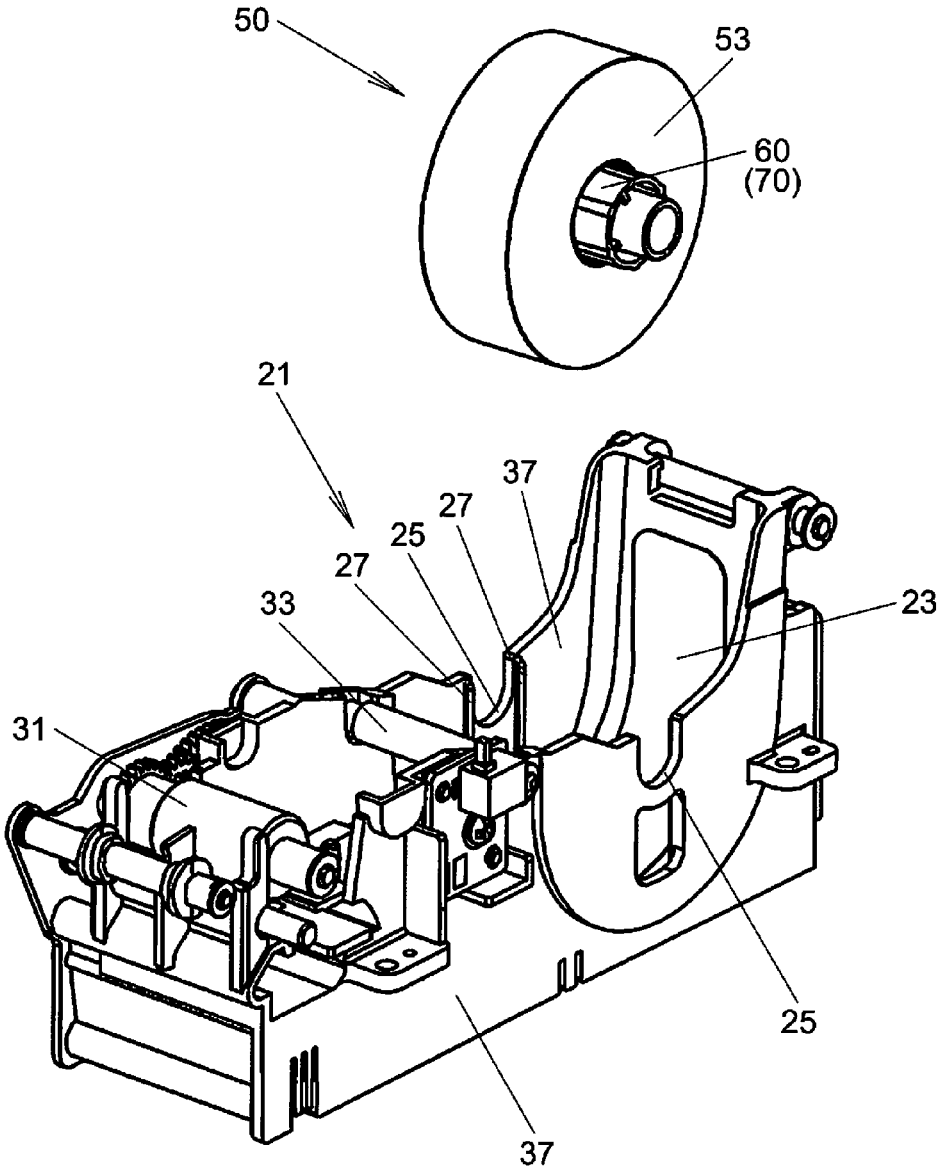
FIG. 3 is a perspective view depicting a printing unit of the printer in which the roll tape according to the roll tape is used.

As shown in FIG. 3, this printing unit 21 uses a chassis of a metal plate and has a roll tape accommodation space 23, the platen roller 31 and a guide roller 33 which rotates in response to the movement of the platen roller 31.

This roll tape accommodation space 23 is formed at a back side of the printing unit 21, and top-opened and U-shaped guide grooves 25 are formed in left and right side plates 37 of the printing unit 21. Then, shaft portions 70 of a tape core 60 are supported by the roll guide grooves 25 at both ends thereof. Guide ribs are formed near the guide groove 25 on an inner side of each side plate 37 so as to determine the position of the tape core 60 in a left-to-right direction.

In addition, the guide roller 33 is provided at the front of the roll tape accommodation space 23 and pulls out a printing tape 53 such as a heat sensitive paper tape which is wound around the tape core 60. This guide roller 33 rotates in synchronism with the platen roller 31 and pulls out the printing tape which is wound into a roll in cooperation with the platen roller 31.

Figure 4:
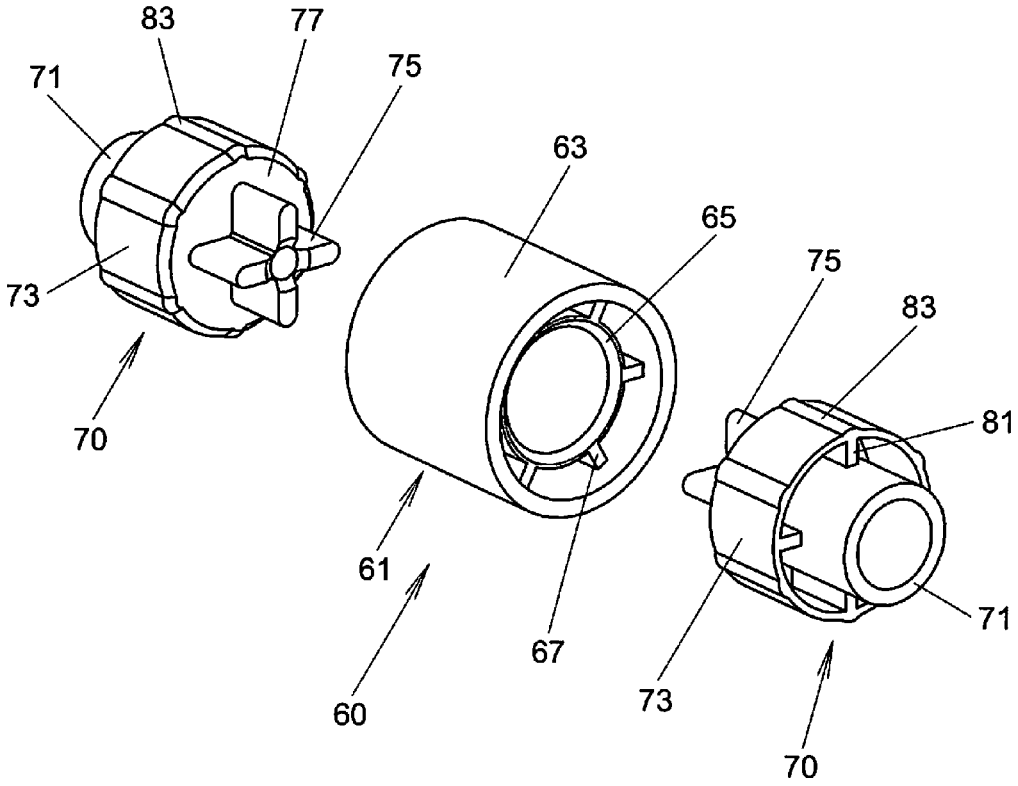
FIG. 4 is an exploded external view of a tape core of the roll tape according to the invention.

The heat sensitive paper tape which is used as a printing tape 53 is synthetic paper to one side of which a removable adhesive having a weak adhesivity is applied. A release coating is applied to an opposite side of the printing tape 53 to the side to which the adhesive is applied, and as shown in FIG. 4, the printing tape 53 is wound around a main body portion 61 of the tape core 60.

This tape core 60 is made up of the one core main body portion 61 and the two shaft portions 70. The core main body portion 61 has a double cylinder construction made up of a cylindrical outer core portion 63 and a cylindrical inner core portion 65. The outer core portion 63 and the inner core portion 65 are concentric with each other, and the inner core portion 65 is fixed to an inner side of the outer core portion 63 with a plurality of plate-shaped spokes 67. Then, a width of the outer core portion 63 which is an axial length thereof is made to coincide substantially with the width of the printing tape 53.

In addition, the shaft portion 70 has a cylindrical or circular pillar-shaped bearing shaft 71 and a cylindrical outer shaft 73 which is concentric with the bearing shaft 71. An axial length of the outer shaft 73 is made shorter than an axial length of the bearing shaft 71. Then, the bearing shaft 71 is held inside the outer shaft 73 by a plurality of plate-shaped auxiliary walls 81 with one end of the outer shaft 73 and one end of the bearing shaft 71 aligned with each other.

Further, a circular disk-shaped end wall 77 is provided at one end of the shaft portion 70 where the one end of the bearing shaft 71 and the one end of the outer shaft 73 are aligned, and this circular disk-shaped end wall 77 has a diameter which is equal to an outside diameter of the outer shaft 73. An insertion portion 75 is provided on the end wall 77 so as to project in an opposite direction to a direction in which the outer shaft 73 extends.

This insertion portion 75 has a cross shape formed by crossing two thin plates, and a position on the end wall 77 where the two plates intersect each other is referred to as the center of the end wall 77. Then, a diameter of a circle which connects outer end portions of the insertion portion 75 is equal to a diameter of the inner core portion 65 and a projecting length of the insertion portion 75 from the end wall 77 is made slightly shorter than a half of an axial length of the inner core portion 65.

In addition, the outside diameter of the cylindrical outer shaft 73 is slightly smaller than a diameter of the outer core portion 63, and a plurality of liner projections 83 which extend in an axial direction are provided on an outer circumferential surface of the outer shaft 73 at equal intervals in a circumferential direction.

Figure 5A:
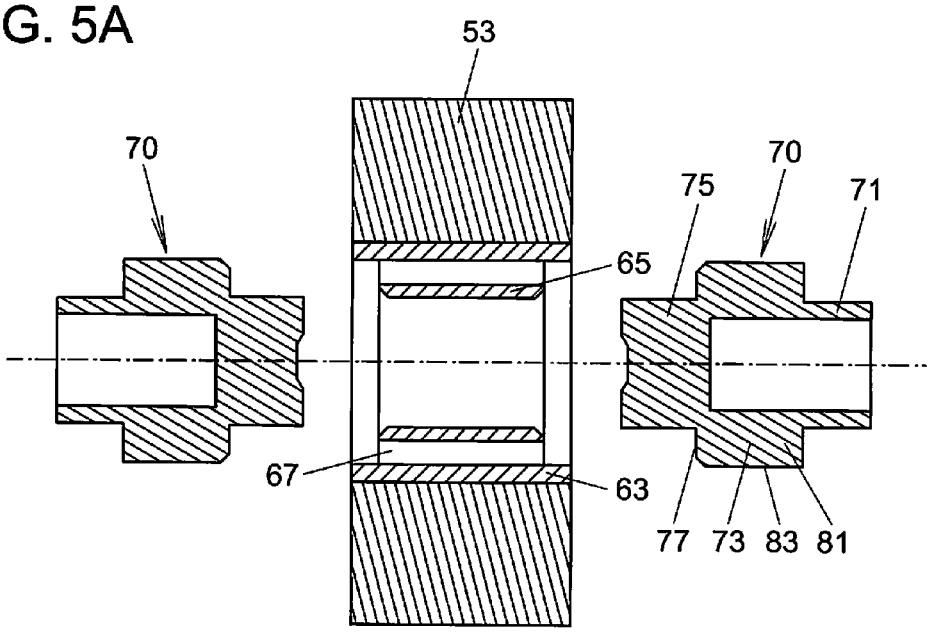
FIGS. 5A and 5B show sectional views depicting an example of the roll tape according to the invention.
Figure 5B:
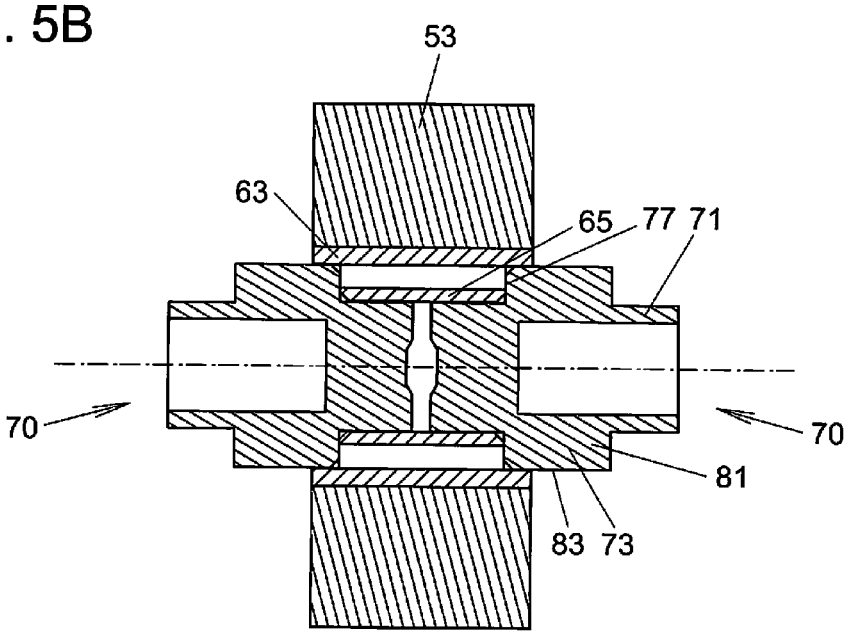

Consequently, when the two shaft portions 70 are respectively inserted into the core main body portion 61 from both sides thereof so that the respective insertion portions 75 of the two shaft portions 70 are inserted into an interior of the inner core portion 65, as shown in FIG. 5B, the insertion portions 75 are fittingly inserted into the inner core portion with the end walls 77 brought into abutment with corresponding ends of the inner core portion 65, whereby the shaft portions 70 are fixed in the main body portion 61 with a slight gap left between distal ends of the left and right insertion portions 75, resulting in a state in which sides of the outer shafts 73 where the end walls 77 are provided are slightly inserted into the outer core portion 63.

It should be noted that as this occurs, the projections 83 provided on the portions of the outer circumferential surfaces of the outer shafts 73 which are fittingly inserted into the outer core portion 63 are brought into contact with an inner side of the outer core portion 63 to thereby realize the stable fixing of the shaft portions 70.

Additionally, as this occurs, a distance between outer end portions of the left and right outer shafts 73 is a length which is substantially equal to a distance which is slightly shorter than a distance between inner sides of the left and right side plates 37 of the printing unit 21. Portions of the bearing shafts 71 which project from the corresponding outer shafts 73 are inserted in the roll guide grooves 25, whereby the roll tape 50 is accommodated within the roll tape accommodating space 23, and a center of the printing unit 21 and a widthwise center of the roll tape 50 are made to coincide with each other with the end portions of the outer shafts 73 of the left and right shaft portions 70 brought into light contact with the corresponding guide ribs 27.

Figure 6A:
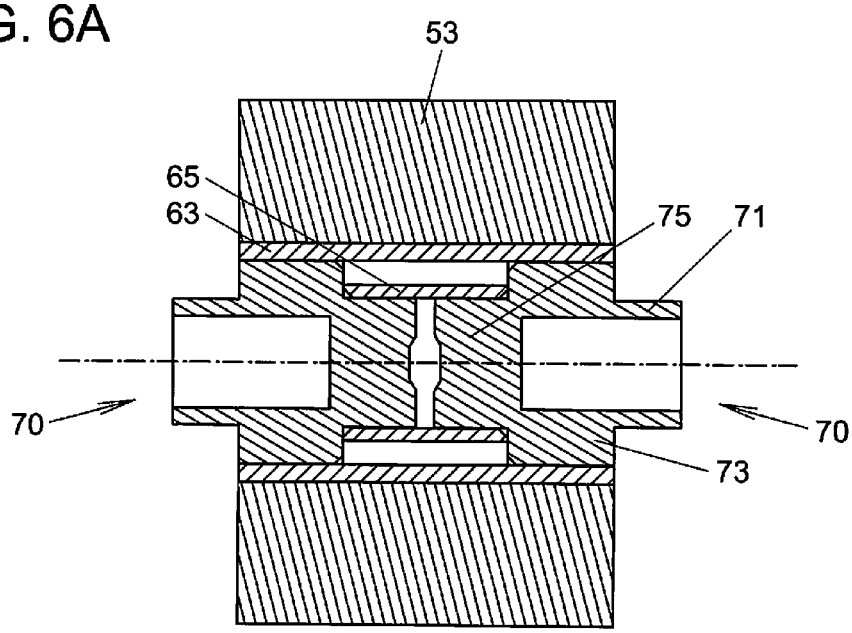
FIGS. 6A and 6B show sectional views depicting examples of roll tapes having different tape widths according to the invention.

Then, in the case of a roll tape 50 made up of a printing tape 53 having a wide tape width, as shown in FIG. 6A, the width of the outer core portion 63 which is the axial length thereof can be extended to its maximum width in which the outer core portion 63 project from both end portions of the inner core portion 65 in the direction of its axial length by a distance equal to an axial length of the outer shaft 73 of the shaft portion 70.

Figure 6B:
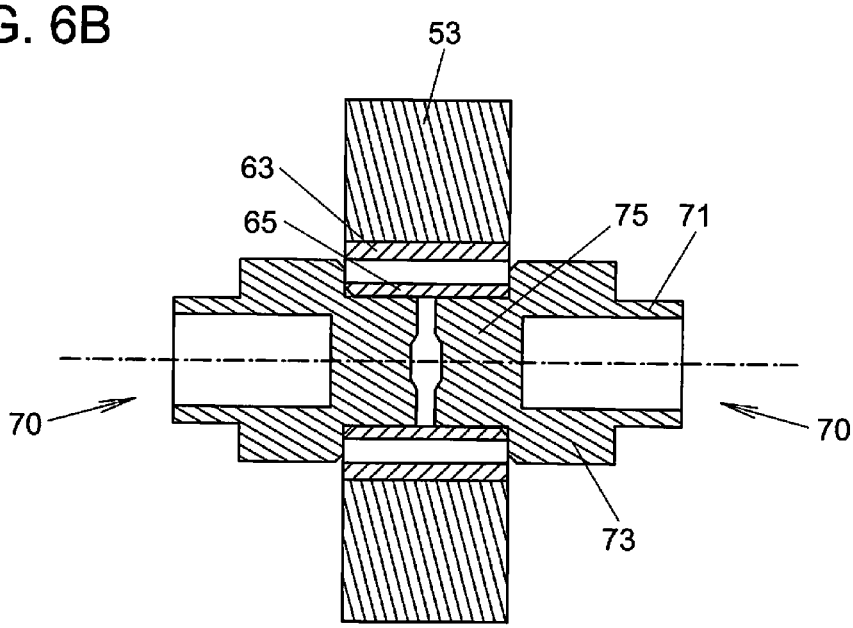

In addition, in the case of a printing tape 53 having a narrow tape width, as shown in FIG. 6B, the width of the outer core portion 63 which is the axial length thereof can be shortened so as to match the width of the printing tape 53.

In this way, in this embodiment, the main body portion 61 adopts the double cylinder construction made up of the inner core portion 65 and the outer core portion 63, and the outer core portion 63 is given the width which matches the width of the printing tape 53 which is the printing tape. Therefore, when winding the printing tape around the tape core 60, it is possible to align the center of the tape core 60 with the center of the printing tape to thereby facilitate the winding of the printing tape around the tape core 60.

Additionally, the insertion portions 75 are fittingly inserted into the inner core portion 65 from both the sides thereof so that the shaft portions 70 are respectively provided at both sides of the core main body portion 61, and therefore, with the sizes and the shapes of the inner core portion 65 and the shaft portions 70 made constant, it is possible to load roll tapes 50 made up of printing tapes of different tape widths in a certain type of printer. In the case of a printing tape of a wide tape width, the respective insertion portions 75 of the outer shafts 73 can be fittingly inserted into the inner core portion 65 with the projections 83 on the outer shafts 73 brought into contact with the inner side of the outer core portion 63. Therefore, with a roll tape 50 having a wide tape width in which a load applied when the tape is pulled out is increased, the tape core 60 is made such that the core main body portion 61 and the shaft portions 70 are connected strongly.

Consequently, by changing only the axial length of the outer core portion 63 while the axial length of the inner core portion 65 remains constant and using the shaft portions 70 of the same size and the same shape, even when a heat sensitive paper tape which is a printing tape 53 of a different tape width is attempted to be used in the same printer 10, since the axial length of the inner core portion 65, the axial length of the outer shafts 73 and the axial length of the bearing shafts 71 remain the same, the printing tape 53 of the different tape width can be loaded in the same printer 10.

In addition, since the width of the printing tape 53 is made to match the width of the outer core portion 63, when the printing tape 53 is wound around the tape core 60 to prepare a roll tape 50, the widthwise centers of the printing tape 53 and the tape core 60 can easily be made to coincide with each other, thereby making it possible to prepare the roll tape 50 in which the widthwise centers of the printing tape 53 and the tape core 60 coincide with each other.

In this way, the roll tape 50 which uses the printing tape 53 can be prepared as a printing tape for a printer on which characters or the like can easily be printed by the printing head 14 without using an ink ribbon, thereby making it possible to prepare various types of labels by reducing the waste of natural resources.

In addition, the space is defined between the bearing shaft 71 and the bearing shaft 71 by providing the spokes 67 therebetween. Additionally, the cylindrical hollow portion is also provided in the bearing shaft 71 along the axis thereof. Further, the core main body portion 61 of the tape core 60 is made up of the outer core portion 63 and the inner core portion 65, and the inner core portion 65 and the outer core portion 63 are made integral with each other by the spokes 67 so as to provide the space therebetween. Thus, the shaft portions 70 and the core main body portion 61 are made light in weight, thereby making it possible to realize the conservation of natural resources.

In addition, the configuration of the insertion portion 75 is not limited to the cross shape which is formed by causing the two plate members to intersect each other. According to another embodiment, a configuration can be adopted in which an insertion portion 75 is made up of plate members which are disposed so as to extend radially in a plurality of directions from the center of an end wall 77. Alternatively, according to a further embodiment, a configuration can also be adopted in which an insertion portion 75 is formed into a cylindrical shape which is concentric with a bearing shaft 71 and an outer shaft 73.

While some embodiments of the invention have been described heretofore, these embodiments have been described as the examples of the invention, and hence, there is no intention to limit the scope of the invention by the embodiments described. These novel embodiments can be carried out in other various ways, and it is possible to make various omissions, replacements or modifications to the embodiments without departing from the spirit and scope of the invention. These embodiments and modifications made thereto are to be included not only in the scope and spirit of the invention but also in the scope of inventions to be claimed later and equivalents thereof.

What is claimed is:

1. A roll tape comprising:

a core main body portion which includes an inner core portion and an outer core portion that extends further axially outwards than the inner core portion and which has a larger diameter than a diameter of the inner core portion;

a pair of shaft portions each including (i) an outer shaft of which at least part of an outer circumference thereof is fittingly inserted into the outer core portion, (ii) an insertion portion that is concentric with the outer shaft and which projects further in a first direction than the outer shaft so that at least part of a circumference thereof is fittingly inserted into the inner core portion, and (iii) a bearing shaft that is concentric with the outer shaft and which projects further in a second direction opposite to the first direction than the outer shaft; and a printing tape which is wound around an outer circumference of the outer core portion of the core main body portion, wherein the pair of shaft portions are coupled with the core main body portion from both axial sides thereof for integral connection; and wherein the outer core portion has an axial length which corresponds to a tape width of the printing tape, and the inner core portion has an axial length which is substantially equal to a sum of axial lengths of the pair of insertion portions, irrespective of the axial length of the outer core portion.

2. The roll tape according to claim 1, wherein the printing tape is a heat sensitive paper tape.

3. The roll tape according to claim 1, wherein an axial length of the outer core portion is a length that is substantially equal to or exceeds the tape width of the printing tape.

4. The roll tape according to claim 1, wherein the inner core portion, the outer core portion, the outer shafts and the bearing shafts are cylindrical.

5. The roll tape according to claim 1, wherein the core main body portion is configured such that the outer core portion and the inner core portion are concentric with each other and such that the inner core portion is fixed to an inner side of the outer core portion by a plurality of plate-shaped spokes.

6. The roll tape according to claim 1, wherein the shaft portion is configured such that the bearing shaft is held inside the outer shaft by a plurality of plate-shaped auxiliary walls so that one end of the outer shaft and one end of the bearing shaft are aligned with each other.

7. A printer comprising:

a roll tape which includes:

a core main body portion which includes an inner core portion and an outer core portion that extends further axially outwards than the inner core portion and which has a larger diameter than a diameter of the inner core portion;

a pair of shaft portions each including (i) an outer shaft of which at least part of an outer circumference is fittingly inserted into the outer core portion, (ii) an insertion portion that is concentric with the outer shaft and which projects further in a first direction than the outer shaft so that at least part of a circumference thereof is fittingly inserted into the inner core portion, and (iii) a bearing shaft that is concentric with the outer shaft and which projects further in a second direction opposite to the first direction than the outer shaft; and a printing tape which is wound around an outer circumference of the outer core portion of the core main body portion, wherein the pair of shaft portions are coupled with the core main body portion from both axial sides thereof for integral connection;

wherein the outer core portion has an axial length which corresponds to a tape width of the printing tape, and the inner core portion has an axial length which is substantially equal to a sum of axial lengths of the pair of insertion portions, irrespective of the axial length of the outer core portion; and wherein the printer further comprises:

a pair of guide grooves which support rotatably the shaft portions; and a printing portion that carries the printing tape while holding an unwound free end of the printing tape by a printing head and a platen which is disposed so as to face the printing head and which prints data on the printing tape.

8. The printer according to claim 7, wherein the printing tape is a heat sensitive paper tape.

9. The printer according to claim 7, wherein an axial length of the outer core portion is a length that is substantially equal to or exceeds the tape width of the printing tape.

10. The printer according to claim 7, wherein the printing head is a thermal head.

11. The roll tape according to claim 7, wherein the core main body portion is configured such that the outer core portion and the inner core portion are concentric with each other and such that the inner core portion is fixed to an inner side of the outer core portion by a plurality of plate-shaped spokes.

12. The roll tape according to claim 7, wherein the shaft portion is configured such that the bearing shaft is held inside the outer shaft by a plurality of plate-shaped auxiliary walls so that one end of the outer shaft and one end of the bearing shaft are aligned with each other.

* * * * *